US006467133B1

(12) United States Patent
Chen

(10) Patent No.: US 6,467,133 B1
(45) Date of Patent: Oct. 22, 2002

(54) ICE SKATE SHOELACE BUCKLE DEVICE

(75) Inventor: Ting-Hsing Chen, Tainan Hsien (TW)

(73) Assignee: Far Great Plastics Industrial Co., Ltd., Tainan Hsien (TW)

( * ) Notice: Subject to any disclaimer, the term of this patent is extended or adjusted under 35 U.S.C. 154(b) by 0 days.

(21) Appl. No.: 09/749,536

(22) Filed: Dec. 28, 2000

(51) Int. Cl.[7] ..... A43C 11/00

(52) U.S. Cl. ..... 24/68 SK; 24/69 SK; 24/70 SK; 24/71 SK

(58) Field of Search ..... 24/68 E, 68 J, 24/68 SK, 69 J, 69 SK, 70 J, 70 SK, 71 J, 71 SK, 69 ST, 265 BC, 265 WS, 311, 574, 629, 642, 633–641, 652, 656, 672; 36/50.1, 50.5

(56) References Cited

U.S. PATENT DOCUMENTS 3,887,966 A * 6/1975 Gley ..... 24/68 CD
3,986,234 A * 10/1976 Frost et al. ..... 24/635
4,193,171 A * 3/1980 Lichowsky ..... 24/68 SK
4,651,392 A * 3/1987 Olivieri ..... 24/71 SK
5,355,562 A * 10/1994 Matoba et al. ..... 24/615 X
5,421,065 A * 6/1995 Miotto ..... 24/70 SK
5,701,639 A * 12/1997 Chen ..... 24/71 SK
5,845,371 A * 12/1998 Chen ..... 24/68 SK
5,974,637 A * 11/1999 Tracy et al. ..... 24/633
6,282,758 B1 * 9/2001 Lin ..... 24/71 SK
6,311,372 B1 * 11/2001 Wang ..... 24/71 SK
6,324,735 B1 * 12/2001 Chen ..... 24/71 SK

* cited by examiner

*Primary Examiner*—Anthony Knight
*Assistant Examiner*—Ruth C. Rodriguez
(74) *Attorney, Agent, or Firm*—Rosenberg, Klein & Lee

(57) ABSTRACT

A buckle device for an ice skate shoelace comprises a buckle, a latch, a spring and a base. The latch is secured to the buckle in such a way that it may slide back and forth with respect to the buckle. A spring connects the buckle and the latch to maintain a closed connection of the two parts. A pair of elastic strips are formed at respective sides of the buckle that correspond to a pair of slanting surfaces of the latch. The latch comprises a recess and a guiding surface at the bottom portion thereof, whereas the guiding surface is to slide along a corresponding rail while the recess is to engage with a hook on the base for securing purpose.

3 Claims, 4 Drawing Sheets

ICE SKATE SHOELACE BUCKLE DEVICE

BACKGROUND OF THE INVENTION

1. Field of the Invention

This invention relates to an ice skate shoelace buckle device, and more particularly to a device which prevents from loosen accidentally.

2. Description of the Prior Art

In-line skating has become one of the popular sports today due to its convenience and safety. Conventional skate shoelace buckles mostly use a press-fit type. The base, shoe and shoelace are all in plastic material, although they use an elastic latch to engage with the hook. The design is so weak that any strike or bump will cause the shoelace to loose, which may cause an accident easily.

SUMMARY OF THE INVENTION

It is the primary object of the present invention to provide an ice skate shoelace buckle device, which is more secure and safe to users.

It is another object of the present invention to provide an ice skate shoelace buckle device, which is easy to operate.

It is a further object of the present invention to provide an ice skate shoelace buckle device, which is cost effective.

DETAILED DESCRIPTION OF THE PREFERRED EMBODIMENT

Figure 1:
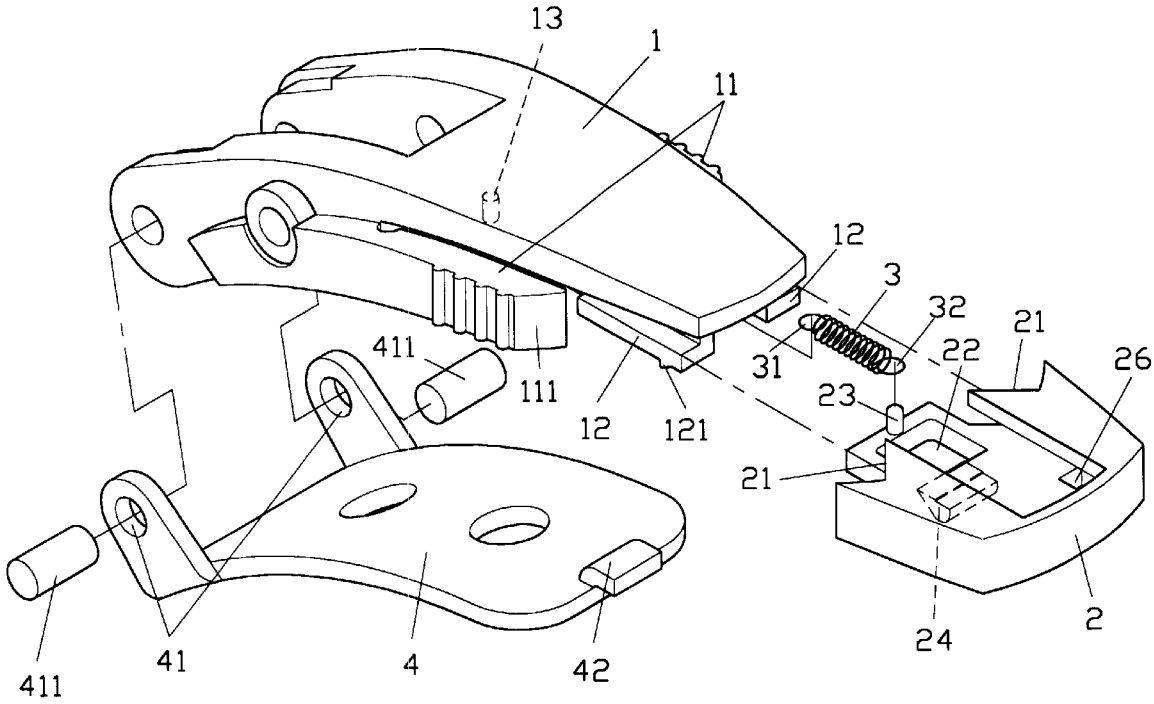
FIG. 1 is an exploded view of the present invention.

A renovated buckle device for an ice skate shoelace of the present invention is composed of a buckle 1, a latch 2, a spring 3 having two hooks 31 and 32 at respective ends, and a base 4

The buckle 1 comprises a pair of elastic strips 11 at respective sides, each strip 11 has a slanting surface 111 at the front end. A pair of rails 12 are formed at the front bottom end respectively. Each rail 12 has a stopper 121 extending downward, the buckle 1 further comprises a stud 13 underneath and is connected to the base 4.

The latch 2 comprises a pair of slanting surfaces 21 at respective rear two ends. A recess 22 is formed at the center rear portion with a stud 23 extending upwards therefrom. A guiding surface 24 is formed underneath the front center portion. A pair of guiding troughs 25 are formed between the center portion and the respective sides, and a restraining groove 26 at the front portion thereof.

The base 4 has a pair of bull eyes 41 at respective two ends, and a hook at the front end thereof, each bull eye 41 is connected to the rear end of the buckle 1 by means of a shaft 411.

Figure 2:
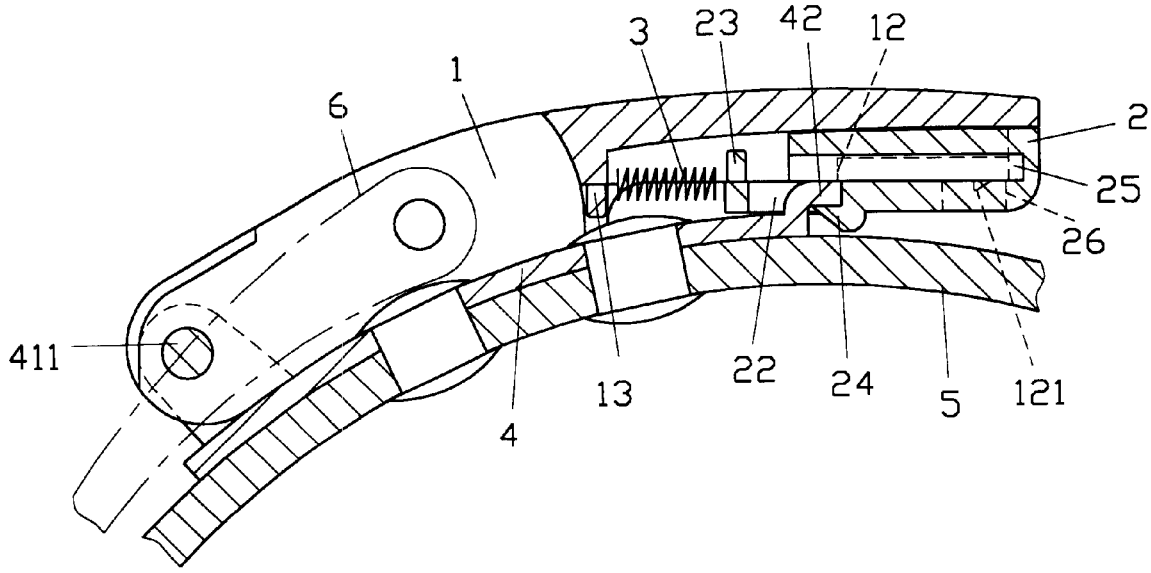
FIG. 2 is a perspective side view of the present invention, partially sectioned

To assemble the present invention, the base 4 is secured on to a skate shoe 5, as shown in FIG. 2, and the buckle 1 is connected to the shoelace 6. The two hooks 31, 32 of the spring 3 are connected to the stud 13 of the buckle 1 and the stud 23 of the latch 2 respectively. The rails 12 of the buckle 1 are clamped into the guiding trough 25 of the latch 2 with the stopper 121 into the restraining groove 26, wherein the spring 3 is in a constant force urging the latch 2 towards the buckle 1.

To buckle up, the latch 2 is pressed towards the buckle 1. The guiding surface 24 presses the hook 42 of the base 4 until the hook 42 reaches to the recess 22, thus the hook 42 hooks to the guiding surface 24, whereas the slanting surface 21 engages with the front end 111 of the strip 11, and the latch 2 is secured to the buckle 1 at this moment.

Figure 3:
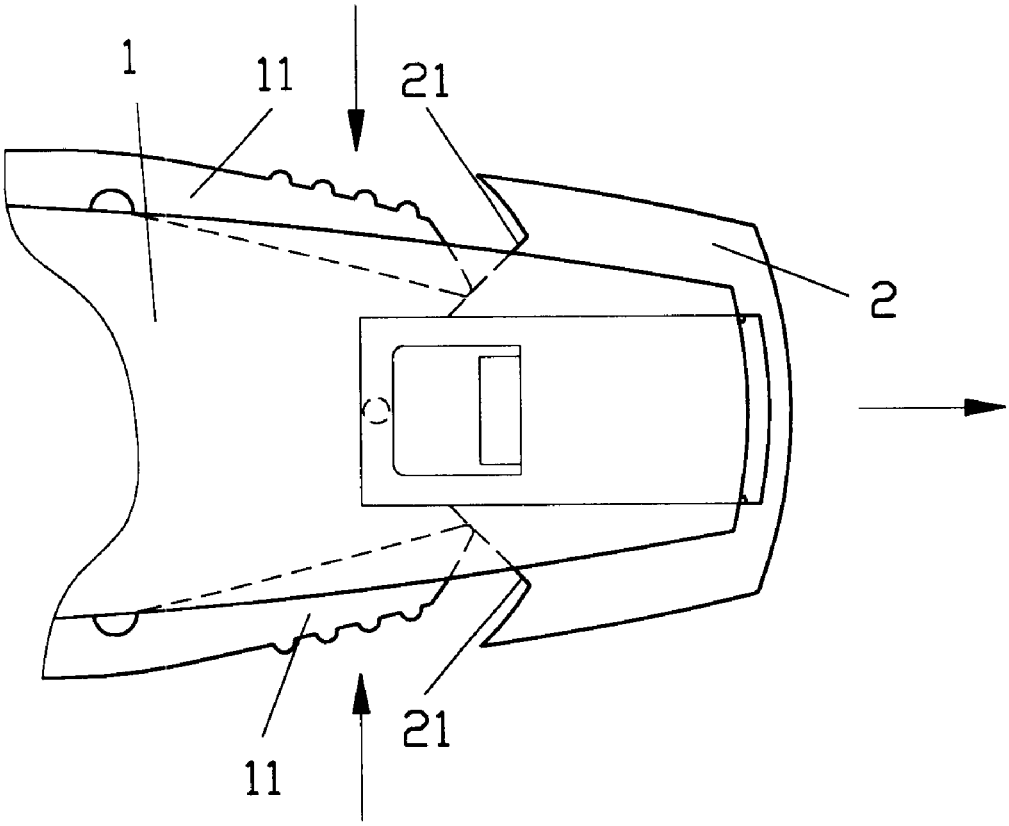
FIG. 3 is a top view of the present invention, showing an operation of a pair of elastic trips to release the latch.
Figure 4:
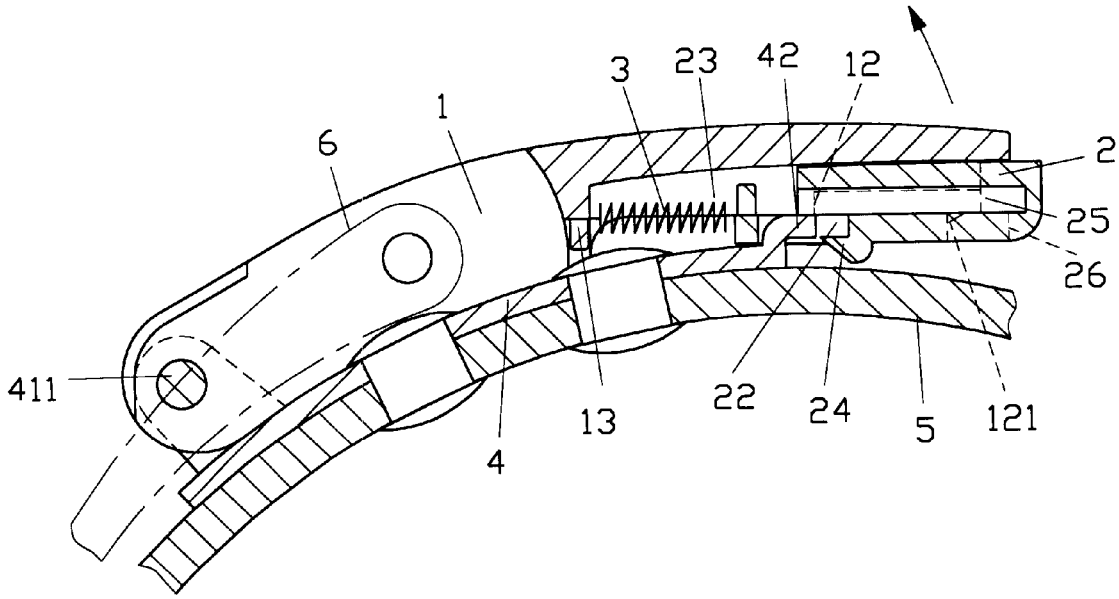
FIG. 4 is a side view of FIG. 3.

To release the buckle 1, the two strips 11 of the buckle 1 are pressed inwardly. The front end 111 of the strip 11 shall push the latch 2 to move backward, as shown in FIG. 3. This will force the guiding surface 24 to disengage with the hook 42, as shown in FIG. 4. Owing to the stopper 121 is engaged with the rear end of the restraining groove 26, the latch is not going to disengage from the buckle 1 instead of the buckle 1 and the latch 2 are able to move upward at this time, and the shoelace 6 is able to be released.

I claim:

1. A renovated buckle device for an ice skate shoelace comprising a buckle, a latch and a base, the improvement comprising said latch engaged with said buckle in a sliding manner, and in a closed constantly engagement by a spring, the two sides of said buckle being formed with a pair of elastic strips, and said latch having also formed with a pair of slanting surfaces at rear both ends respectively and corresponding to said strips, a recess and a guiding surface underneath said latch to be engaged with a hook of said base, whereas by pressing said strips, said latch may release said hook of said base from said guiding surface of said latch.

2. The renovated buckle device for an ice skate shoelace, as recited in claim 1, wherein said buckle comprises a pair of elastic strips, and a pair of rails being formed at the front underneath thereof, each rail having a stopper at front bottom end, a pair of slanting surfaces at rear two ends of said latch, each corresponding to said strip of said buckle, a recess at center rear end of said latch with a guiding surface underneath, a guiding groove being formed between the center portion and respective sides, and a restraining groove being formed at one side of said center portion, whereas at front bottom portion of said rails clamped within said guiding surface while said stopper of said slanting surface of said buckle being clamped in said restraining groove.

3. The renovated buckle device, as recited in claim 2, wherein said buckle comprises a stud at center bottom portion extending downwardly, and said latch also comprising a stud extending upwardly, said studs being secured with the two ends of said spring.

* * * * *